US012806738B2

(12) United States Patent
Nguyen et al.

(10) Patent No.: US 12,806,738 B2
(45) Date of Patent: Nov. 24, 2026

(54) APPARATUS, METHODS, AND SYSTEMS FOR ABRASIVE BLASTING

(71) Applicant: Axxiom Manufacturing, Inc., Fresno, TX (US)

(72) Inventors: Phuong Taylor Nguyen, Richmond, TX (US); Jade David Fogg, Nottingham, NH (US); Antony Rodriguez, Rosenberg, TX (US)

(73) Assignee: Axxiom Manufacturing, Inc., Fresno, TX (US)

( * ) Notice: Subject to any disclaimer, the term of this patent is extended or adjusted under 35 U.S.C. 154(b) by 341 days.

(21) Appl. No.: 18/511,073

(22) Filed: Nov. 16, 2023

(65) Prior Publication Data

US 2024/0189963 A1 Jun. 13, 2024

Related U.S. Application Data

(60) Provisional application No. 63/431,457, filed on Dec. 9, 2022.

(51) Int. Cl.
*B24C 7/00* (2006.01)

(52) U.S. Cl.
CPC ..... *B24C 7/0038* (2013.01); *B24C 7/0053* (2013.01)

(58) Field of Classification Search
CPC .... B24C 3/02; B24C 3/04; B24C 5/02; B24C 7/0007; B24C 7/0015; B24C 7/0023; B24C 7/003; B24C 7/0038; B24C 7/0053; B24C 7/0061; B24C 7/0069; B24C 7/0076
See application file for complete search history.

(56) References Cited

U.S. PATENT DOCUMENTS

| | | | | |
|---|---|---|---|---|
| 5,421,767 | A * | 6/1995 | Spears, Jr. | B24C 5/04 451/75 |
| 9,925,642 | B2 * | 3/2018 | Eliason | B24C 7/0015 |
| 2016/0236323 | A1 * | 8/2016 | Mase | B24C 1/08 |
| 2020/0094377 | A1 * | 3/2020 | Turner | B24C 7/0084 |
| 2020/0108484 | A1 * | 4/2020 | Kavka-Coogan | B24C 7/0023 |
| 2022/0241930 | A1 * | 8/2022 | Nguyen | B05B 7/1431 |

FOREIGN PATENT DOCUMENTS

| | | | | |
|---|---|---|---|---|
| CN | 112276802 A | * | 1/2021 | B24C 9/00 |
| WO | WO-9522432 A1 | * | 8/1995 | B24C 7/0038 |

OTHER PUBLICATIONS

Machine translation of CN-112276802-A (Year: 2021).*

* cited by examiner

*Primary Examiner* — Nathaniel E Wiehe
*Assistant Examiner* — Jason G Davis
(74) *Attorney, Agent, or Firm* — Kearney, McWilliams & Davis, PLLC; John M. DeBoer

(57) ABSTRACT

An abrasive blasting system that includes a blast hose; and a deadman assembly operably coupled therewith for controlling discharge out of the blast hose. The deadman assembly has a position of either a signal-flow or a no-flow position. When engaged to the signal-flow position, a burst or pulse of purge air is transferred to a mixer via a water injection conduit.

17 Claims, 6 Drawing Sheets

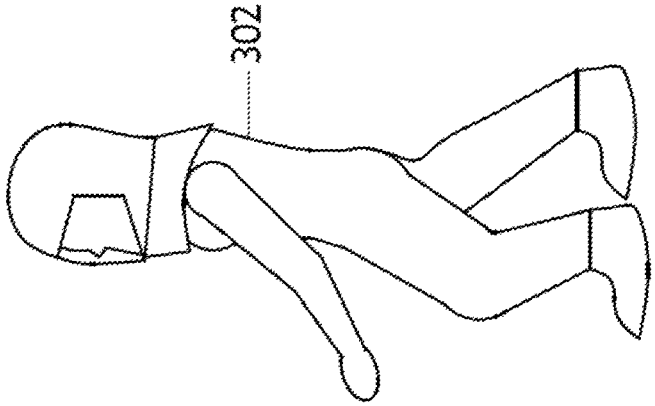
Figure 3A
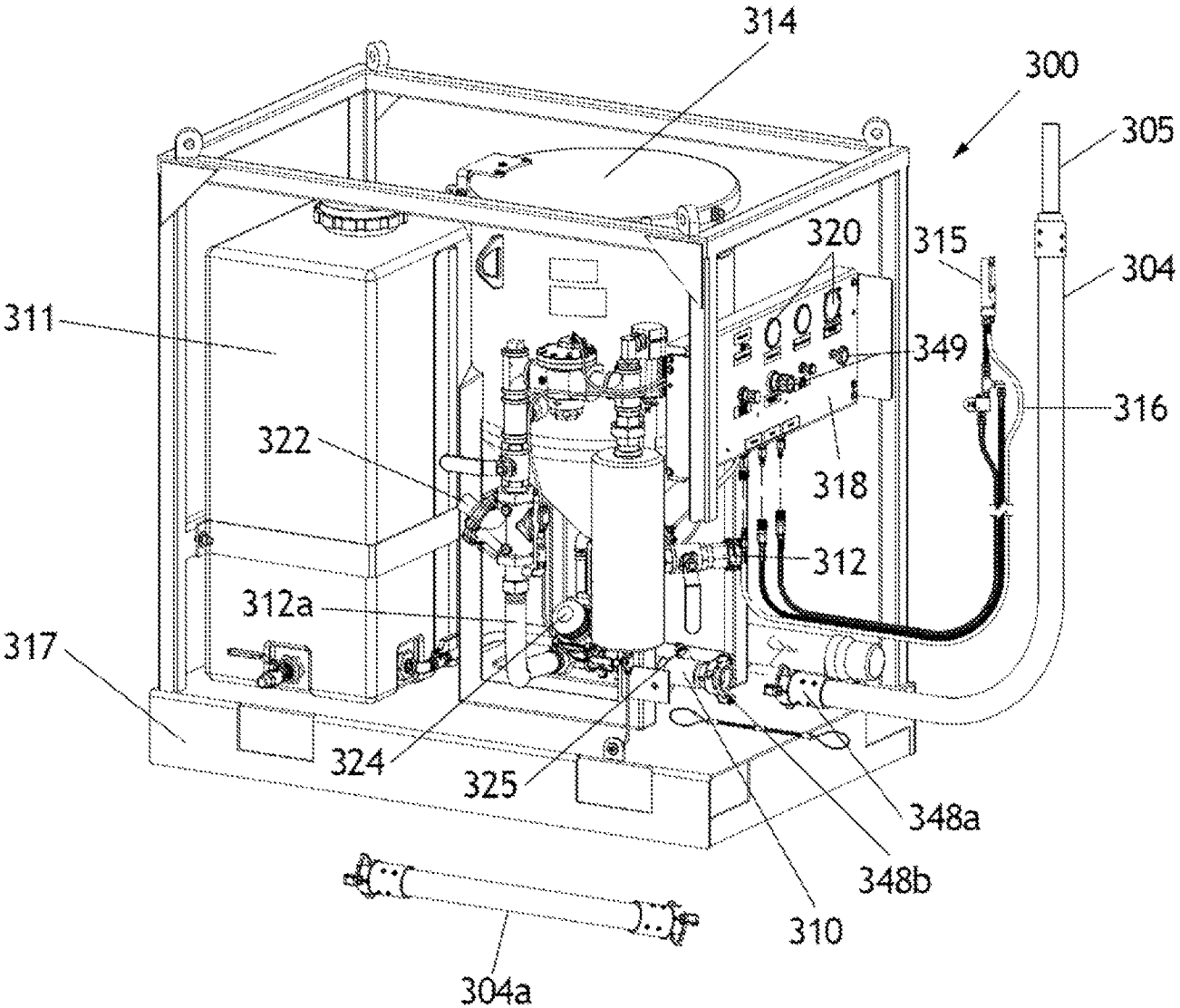

APPARATUS, METHODS, AND SYSTEMS FOR ABRASIVE BLASTING

STATEMENT REGARDING FEDERALLY SPONSORED RESEARCH OR DEVELOPMENT

Not Applicable.

BACKGROUND

Field of the Disclosure

This disclosure generally pertains to abrasive blasting, with related apparatuses, methods, and systems, where the blasting may be wet, dry, or combinations thereof. More specifically, the disclosure relates to improved operation of an abrasive blasting unit or system.

Background of the Disclosure

Abrasive blasting is the process of forcibly propelling a high pressure, high velocity stream of abrasive material against a surface in order to smooth a rough surface, roughen a smooth surface, shape a surface, or remove surface materials, such as contaminants, paint, etc.

FIG. 1 illustrates a typical abrasive blasting process (or system) 100, sometimes referred to as sand-blasting (a form of dry media blasting), has been used for decades to clean or otherwise prepare various types of structural surfaces. In this type of process 100, a supply of abrasive media (sand or other types of particles, such as grit or the like) 114 is mixed with a fast-moving stream of air 112, usually in a mixer or valve 110. The media 114 becomes entrained in the air 112, and the resultant air-abrasive mixture 106 emerges at high speed from a nozzle 105 at the end of a blast hose 104. Abrasive blasting can be used to remove even strongly-adhered compounds (e.g., paint, etc.) from various types of structural surfaces 108.

The discharge of the air-abrasive media mixture 106 is hazardous for multiple reasons. First, particulate from the discharge, and as well as the blasted-surface, will linger in the air in the form of a cloud 107, making breathing difficult. As such, a breathing hood or suit 101 may be worn by an operator 102 (the suit 101 may be fed breathing air 103).

Dry media blasting systems have proven to be very effective, but such systems are prone to release of blast media or dust into the surrounding area during operation. There are frequent situations where dust containment or suppression is desirable or required.

Wet media blasters have been created to minimize the generation of airborne media during blasting operations. In a broad sense, there are many units that combine water and abrasive and release the flow of the pressurized combination into a stream of pressurized air through a nozzle.

In industrial applications, there are commonly two types of wet media blasting systems. In the first, water (not shown here) is initially mixed in with the media in a media storage tank, then the resultant mixture introduced into a pressurized air flow, and then finally the combined stream released out through a blast hose/nozzle coupled therewith. In the second, the abrasive media and air are first mixed together upstream of a water injection system.

These wet systems are inefficient, and are known to waste undesirable amounts of water. Such systems are also prone to failure when the dry abrasive clogs the water release system including at times requiring a complete shutdown and cleaning of the water delivery system.

For example, before system 100 is engaged and operational, one or more components may be at atmospheric. This is also true of the devices used to put components in fluid communication (such as tubing or piping) with each other. When engaged, an air valve may open to start the blast, which may inadvertently pressurize the water injection tubing in dry blasting, but also may initially pressurize a portion of the tubing in wet blasting before the water has had a chance to fill the tubing. This action may result in forcing small abrasive particles into the water injection nozzles and tubing, and in time could stick inside the nozzle orifice clogging it.

Such systems also have poor or limited control of water usage. For example, in flow orifice control systems, changes in water pressure result in changes in water flow rate. Presence of water flow at high flow rates results in fluctuations (e.g., pulsing). Presence of water flow at low flow rates results in inconsistency and could cycle between flow and no flow conditions.

SUMMARY

Embodiments of the disclosure pertain to an abrasive blasting system that may include any of: a blast hose; and a deadman assembly coupled directly or indirectly with the blast hose. The blast hose may be coupled with or part of an abrasive blasting unit or skid.

Embodiments of the disclosure pertain to an abrasive blasting system that may include: a blast hose; a mixer or mixer section; and a deadman assembly. The deadman assembly may be operably configured to be in a deadman position of one of: a signal-flow position and a signal-no flow position.

The system may include an air source coupled with the mixer via an air injection conduit in order to provide an air flow to the mixer in response to the deadman position. The air source may be a compressor. The system may include a water source coupled with the mixer via a water injection conduit. The water source may be a tank or other suitable device. The system may include an abrasive source coupled with the mixer via a media conduit in order to provide a media flow in the mixer. The media flow may be in response to the deadman position.

In aspects, upon engagement of the deadman assembly to the signal-flow position, at least part of the air flow may be diverted into the mixer via the water injection conduit.

The system may include a control panel configured with a mode selector operably coupled with the water source.

The water injection conduit may be associated with a first water injector disposed in or coupled with the mixer. The water injection conduit may be associated with a second water injector disposed in or coupled with the mixer. In aspects, water flow may be provided to the mixer via either the first water injector or the second water injector or both. The water injector used may be based upon a mode selector position of the mode selector.

The mode selector position may include one or more of: a water blast mode and a water washdown mode. The pressure of the water flow in the mixer in the water blast mode may be greater than the pressure of the water flow in the mixer in the washdown mode.

The system may include a water pump for providing a pressurized water from the water source to the water injection conduit. There may be a first water regulator for reducing a pressure of the pressurized water and stabilizing flow. There may be a second water regulator for further reducing the pressure of the pressurized water, further stabilizing flow and metering water flow rate. The system may include a snubber tank disposed between the water pump and the first water regulator.

Embodiments of the disclosure pertain to an abrasive blasting system that may include one or more of: a blast hose; a mixer coupled with the blast hose; and a deadman assembly operably configured in a deadman position of one of: a signal-flow position and a signal-no flow position.

The system may include an air source coupled with the mixer via an air injection conduit, which may be used to provide an air flow to the mixer in response to the deadman position. There may be a water source coupled with the mixer via a water injection conduit. There may be an abrasive source coupled with the mixer via a media conduit, which may be used to provide a media flow in the mixer in response to the deadman position.

In aspects, upon engagement of the deadman assembly to the signal-flow position, at least part of the air flow is diverted into the mixer via the water injection conduit.

The system may include a control panel configured with a mode selector operably coupled with the water source. There may be a water injector, such as a first water injector. The first water injector may be coupled with or otherwise disposed in the mixer. There may be a second water injector disposed in the mixer.

In operation, a water flow from the water source may be (selectively) provided to the mixer via at least one of the first water injector, the second water injector, and combinations thereof. The provision of water may be based upon a mode selector position of the mode selector. The mode selector may include modes such as a water blast mode and a water washdown mode, with other non-water modes possible. The pressure of the air flow in the mixer in the water blast mode may be greater than the pressure of the water flow in the mixer in the washdown mode.

The system may include other components, such as a water pump, which maybe operable to provide a pressurized water from the water source to the water injection conduit. There may be a first water regulator, which may be used to control an operation parameter of the pressurized water. The system may include a second water regulator. The second water regulator may be in fluid communication with the first water regulator. The first water regulator may be operable to stabilize a water flow rate and a water pressure of a water flow to the second water regulator. The second water regulator may be configured to control an operation parameter of the water flow. The second water regulator may be operable for metering the water flow to a first water injector. In aspects, there may be a snubber tank disposed between the water pump and the first water regulator.

Yet other embodiments of the disclosure pertain to an abrasive blasting system that may include one or more of: a blast hose; a mixer coupled with the blast hose; a water pump operable to provide a pressurized water flow; a snubber in fluid communication with the water pump; a main water regulator downstream of the snubber; a second water regulator downstream and in fluid communication with the main water regulator; a deadman assembly operably configured to be in a deadman position of one of: a signal-flow position and a signal-no flow position; an air source coupled with the mixer via an air injection conduit in order to provide an air flow to the mixer in response to the deadman position; a water source coupled with the water pump in order to provide a water flow to the water pump in response to the deadman position; an abrasive source coupled with the mixer via a media conduit in order to provide a media flow in the mixer in response to the deadman position; a first water injector in fluid communication with each of the air source and the water source. In operation, upon engagement of the deadman assembly to the signal-flow position, at least part of the air flow may be diverted into the mixer via the first water injector.

Yet other embodiments of the disclosure pertain to an abrasive blasting system that may include a blast hose; a mixer coupled with the blast hose; and a water pump operable to provide a pressurized water flow. There may be a snubber in fluid communication with the water pump (discharge) in order to receive the pressurized water flow. The snubber may provide a snubber outlet flow.

The system may have a flow control scheme. For example, there may be a main water regulator configured to receive the snubber outlet flow and adjust a related parameter. For example, the main water regulator may be used to reduce its pressure to form a first reduced pressure flow. There may be a second water regulator that received an outlet stream from the first water regulator. The second water regulator may be used to adjust or control a related parameter. For example, the second water regulator may be configured to receive the first regulator outlet and (further) reduce its pressure to form a second reduced pressure flow.

The system may include a deadman assembly. The deadman assembly may be operably configured to be in a deadman position of one of: a signal-flow position and a signal-no flow position.

The material or mediums for the system may come from one or more sources. For example, there may be an air source coupled with the mixer via an air injection conduit, which may be used in order to provide an air flow to the mixer in response to the deadman position. There may be a water source coupled with the water pump, which may be used to provide a water flow to the water pump in response to the deadman position. There may be an abrasive source coupled with the mixer via a media conduit, which may be used to provide a media flow in the mixer in response to the deadman position.

The system may include a first water injector coupled in fluid communication with either or each of the air source and the water source. In aspects, upon engagement of the deadman assembly to the signal-flow position, at least part of the air flow may be diverted into the mixer via the first water injector.

The system may include an air flow valve; and a water control valve. There may be a purge line coupled between the air flow valve and the first water injector. There may be a second water injector configured to receive pressurized air from the air flow valve via a respective purge line coupled between the air flow valve and the second water injector. The system may include a control panel configured with a mode selector operably coupled with the water source.

In aspects, water flow may be provided to the mixer via at least one of the first water injector, the second water injector, and combinations thereof, based upon a mode selector position of the mode selector. The mode selector position may include multiple mode options, such as: a water blast mode and a water washdown mode. The pressure of the air flow in the mixer in the water blast mode may be greater than the pressure of the water flow in the mixer in the washdown mode.

The system may include a blast mode check valve, which may be disposed between the second water regulator and the first water injector. There may be a washdown check valve, which may be disposed between the second water regulator and the second water injector. In operation, a cracking pressure of the blast mode check valve may be less than a respective cracking pressure of the washdown check valve.

The system may be configured whereby backflow of any abrasive or water through the first water injector may be prevented by pressurized air transferred from the air flow valve in dry blast or blowdown modes. In other aspects, backflow of any abrasive or water through the first water injector may be prevented by pressurized water transferred from the second regulator in water blast and washdown modes. In yet other aspects, backflow any abrasive or water through the second water injector may be prevented by pressurized air transferred from the air flow valve in dry blast, water blast or blowdown modes. Still further, backflow of any abrasive or water through the second water injector is prevented by pressurized water transferred from the second regulator in washdown mode. Lastly, backflow of any water through the purge line to the air flow valve may be prevented by the blast mode and washdown check valves.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein:

FIG. 3A shows an isometric view of an abrasive blasting system according to embodiments of the disclosure;

DETAILED DESCRIPTION

Figure 1:
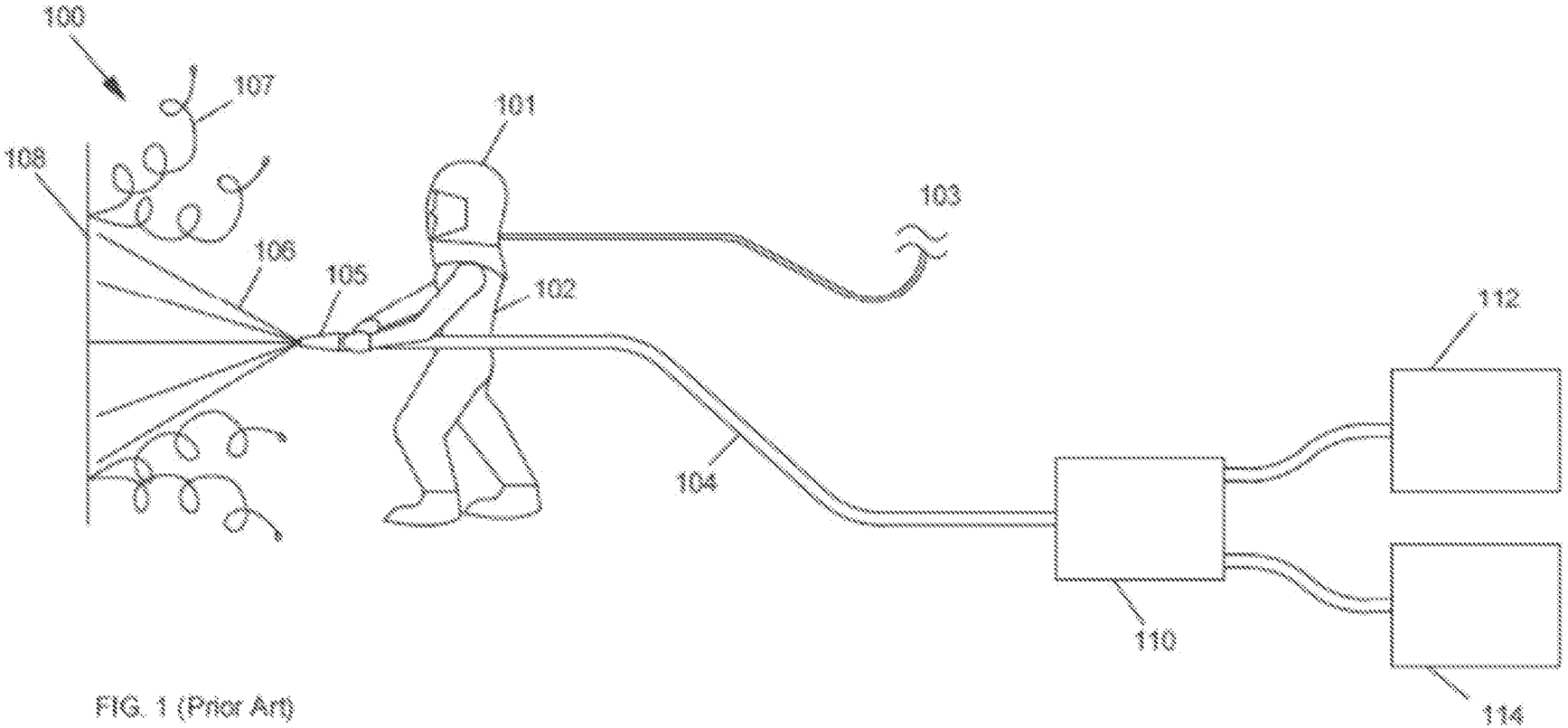
FIG. 1 (Prior Art)
FIG. 1 shows a typical abrasive blasting process according to embodiments of the disclosure.

Regardless of whether presently claimed herein or in another application related to or from this application, herein disclosed are novel apparatuses, units, systems, and methods that pertain to hose-use operations such as abrasive blasting, details of which are described herein.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. Various equipment may be in fluid communication directly or indirectly with other equipment. Fluid communication may occur via one or more transfer lines and respective connectors, couplings, valving, piping, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, melt index, etc., is from 100 to 1,000. it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Numerical ranges are provided within this disclosure for, among other things, the relative amount of reactants, surfactants, catalysts, etc. by itself or in a mixture or mass, and various temperature and other process parameters.

Without limitation otherwise, the make and manufacture of any particular component, subcomponent, etc., described herein may be as would be apparent to one of skill in the art, such as molding, forming, press extrusion, machining, additive manufacturing, etc. Components, subcomponents, etc. may be metallic, plastic, composite, and so forth, and need not all be of the same material. Embodiments of the disclosure provide for one or more components to be new, used, and/or retrofitted to existing machines and systems.

For any embodiment of the disclosure, associated or auxiliary equipment including automation, controllers, piping, hosing, valves, wiring, nozzles, pumps, gearing, tanks, etc. may be shown only in part, or may not be shown or described, as one of skill in the art would have an understanding of coupling the components for operation thereof.

Any component herein that utilizes power or automation may be provided with wiring, tubing, piping, etc. in order to be operable.

Terms

The term "connected" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "pipe", "conduit", "line", "tubular", "hose", or the like as used herein may refer to any fluid transmission means, and may (but need not) be tubular in nature. The term may also apply to other forms of transmission, such as electrical.

The term "composition" or "composition of matter" as used herein may refer to one or more ingredients, components, constituents, etc. that make up a material (or material of construction). Composition may refer to a flow stream of one or more chemical components.

The term "utility fluid" as used herein may refer to a fluid used in connection with the operation of an abrasive blasting device, such as a grit (sand), air, or water. The utility fluid may be for blasting, heating, cooling, or other type of utility. 'Utility fluid' may also be referred to and interchangeable with 'service fluid' or comparable.

The term "mounted" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth.

The term "non-emergency release" as used herein may refer to a voluntary release of a trigger/level mechanism of a deadman assembly in order to accomplish some other task, such as a break for shift change, a meal, or visit to a restroom, or to reposition for blasting a new area.

The term "deadman" as used herein may refer to an operable system or assembly utilizing some form of switch or comparable mechanism that, upon release of the 'deadman', results in shutdown. With respect to a blasting operation, release of the deadman may refer to a shutdown of media transfer through a blast line.

The term "control valve" as used herein may refer to a valve configured to control flow of a fluid, a solid, a slurry, etc. through the valve by varying the size of the flow passage as directed by a signal from a controller. The opening or closing of a control valve may be by electrical, hydraulic, or pneumatic actuators, or the like. The control valve may receive a signal from a deadman assembly in order to control other valves such as metering, combination or air valves.

The term "pneumatic" as used herein may refer to a device or piece of equipment operable or otherwise responsive to some form of air (or other suitable gas) pressure.

The term "metering valve" as used herein may refer to a type of valve associated with a solid, such as sand, grit, and the like. Such a valve may be multi-function. For example, the metering valve may control flow of the solid into a compressed air stream. Another function may be to regulate the solid flow by changing the orifice size in the valve body. The larger the orifice the greater the solids flow. The metering valve may be a media valve.

The term "machined" may refer to a computer numerical control (CNC) process whereby a robot or machinist runs computer-operated equipment to create machine parts, tools and the like.

Figure 2:
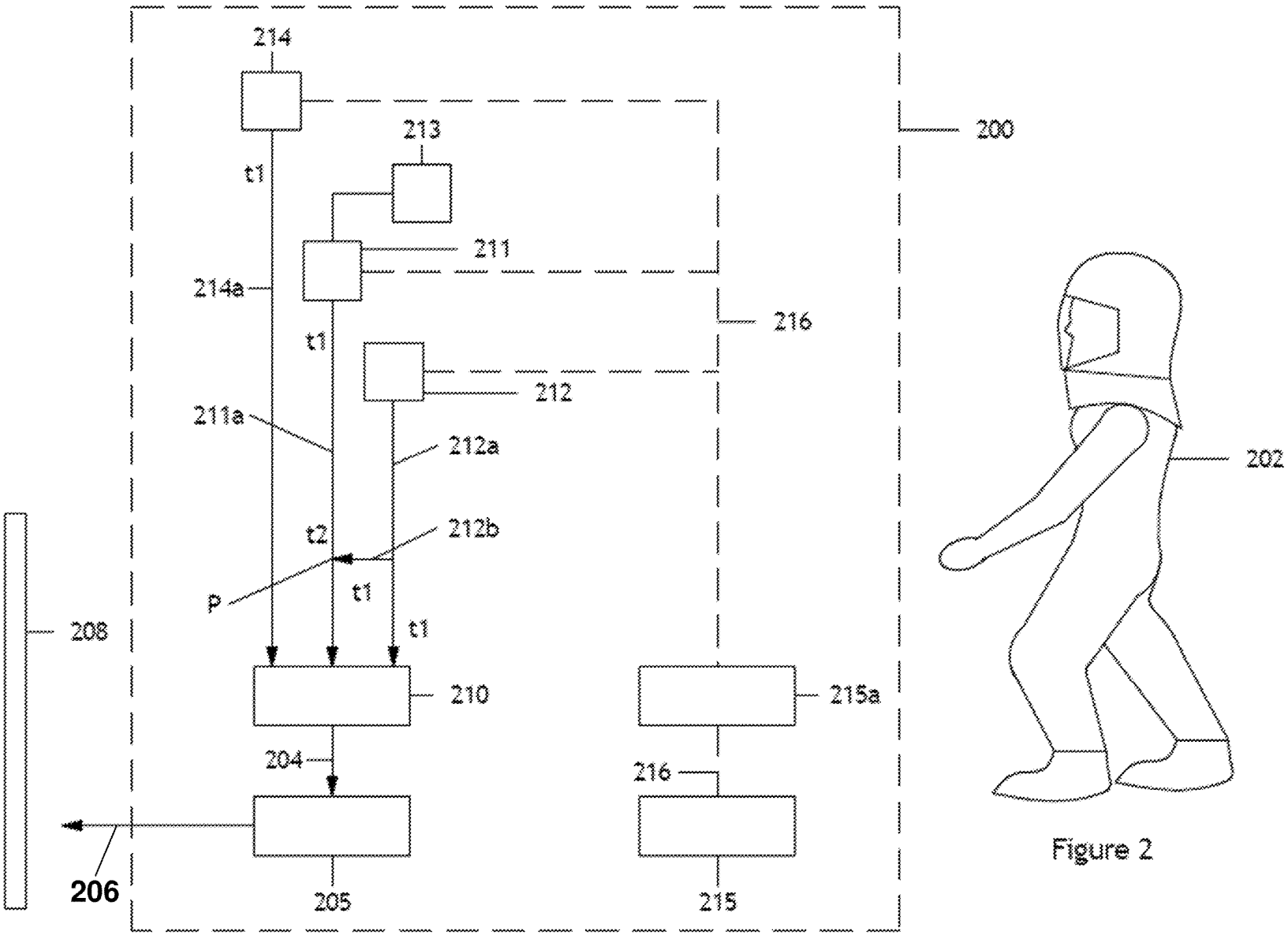
FIG. 2 shows a process flow diagram view of an abrasive blasting system according to embodiments of the disclosure.

Referring now to FIG. 2, a process flow diagram view of an abrasive blasting system, illustrative of embodiments disclosed herein, is shown. FIG. 2 is a simplified 'box' diagram that illustrates an abrasive blasting system 200 for use in treating a surface 208. One of skill would appreciate the basic nature of FIG. 2 does not show detail of valving, fittings, conduits, pumps, controls, etc. that might otherwise be present or necessary.

The blasting system 200 may be multi-mode. For example, there may be a first mode of just blast air, while another mode may be wash down. The blasting system 200 may be in a no-blast or shutdown mode or configuration, which normally entails an operator 202 releasing (or otherwise not squeezing/engaging) a deadman assembly 215. Without any limitation, the deadman assembly 215 may be pneumatic, electrical, or the like, but may otherwise have be associated with deadman logic 215*a* interrelated to other parts of the system 200 via deadman networking 216.

The deadman assembly 215 may be suited for applications that permit a blast hose 204 (or an area proximate thereto) to be held by an operator 202 facing forward during operation. When the deadman 215 is in an unengaged (or unsqueezed, etc.) or released position, this may correspond to a signal no-flow position. The release or disengagement of the deadman 215 may have a moment in time contemplated as to.

Signal transmission through network 216 via engagement (squeezing) of the deadman 215 (such as via a trigger or lever) may be transferred to one or more valves or other devices (not shown in detail here). The initial moment(s) of engaging the deadman 215 may be contemplated as $t_1$, and may correspond to a signal-flow position. In embodiments $t_1$ may correspond to a temporal range of 0.01 seconds to about 1.5 seconds.

Air source 212 may be in fluid communication with multiple flow paths. For example, source 212 may provide control air to control devices of the system 200, such as one or more control valves (not shown here). When the deadman 215 is engaged, a control device(s) may be activated via a signal (e.g., pneumatic, electrical, etc.), and then the device may signal other valves or devices to an active position; when the deadman 215 is disengaged, the signal may stop, and the other valves or devices may be deactivated.

The air source 212 may also provide blast or mixing air to a mixer (mixer section, chamber, conduit, nozzle, etc.) 210 via air injection conduit 212*a*. During engagement at $t_1$, there may be an immediate (or instantaneous) burst or pulse of airflow through purge branch 212*b* directed into a water injection conduit 211*a* at junction point P. One of skill would appreciate that the air injection conduit 212*a* may be slightly larger in OD than purge branch 212*b* and/or conduit 211*a*, and thus while air flow might enter the mixer 210 from conduits 212*a* and 211*a* at the same time, the pressure of the air entering the mixer 210 from conduit 212*a* will be less than the pulse of air entering the mixer 210 from conduit 211*a*. This difference in pressure at time $t_1$ is what facilitates formation of the pulse.

The purge pulse in 211*a* is akin to a dam, since it may block or limit any backflow or clogging of the conduit 211*a* (or any respective injector). The pulse may help sufficiently clear any remnant or flowing particulate (or other debris) at $t_1$ from the mixer 210 (or any respective injection orifice—not shown here).

Although at $t_1$ water from water source 211 may flow into the water injection conduit 211*a*, as a result configuration variables (line length, compressible/incompressible, etc.), the water may not reach the junction point P until some amount of time after $t_1$, and thus after the pulse. Water may reach the junction point P and the mixer 210 at a point of time $t_2$. In the moment prior to water reaching point P, the pulse of airflow may thus successfully enter the mixer 210 via branch 212*b*/water conduit 211*a*.

In a similar manner, once an activation signal is received from the deadman 215, an abrasive media may transfer from media storage 214 through a media transfer conduit 214*a* into the mixer 210 ($t_1$ or thereafter).

At $t_2$ (or any time thereafter for any further moment the deadman 215 remains engaged), water, air, and/or abrasive may flow (or continue to flow) from their respective conduits into the mixer 210. What type of material flows to the mixer 210 may be further dependent on a mode of operation of the system 200. For example, if an air-only mode is used, the air pressure in 211*a* and 212*b* may eventually equalize. If a water mode is used, purge air no longer flows into the water injection conduit 211*a*, as the conduit 211*a* will fill with water. Upon mixing, the resultant blast or mix media 206 may discharge from the nozzle 205 and impact against the surface 208 to accomplish the desired blasting outcome. The amount of water used (which could be zero if dry blasting) may be controlled or regulated by a regulator circuit 213. Once the deadman 215 is released, the sequence stops and may begin again upon subsequent (re)engagement.

Referring now to FIGS. 3A, 3B, 3C, and 3D, an isometric view of an abrasive blasting system, a close-up side profile view of a mixer when the abrasive blasting system has a deadman assembly disengaged, a close-up side profile view of the mixer when the deadman assembly is engaged, and a close-up side profile view of the mixer when the deadman assembly remains engaged, respective, illustrative of embodiments disclosed herein, are shown.

Figures 3B, 3C, 3D:
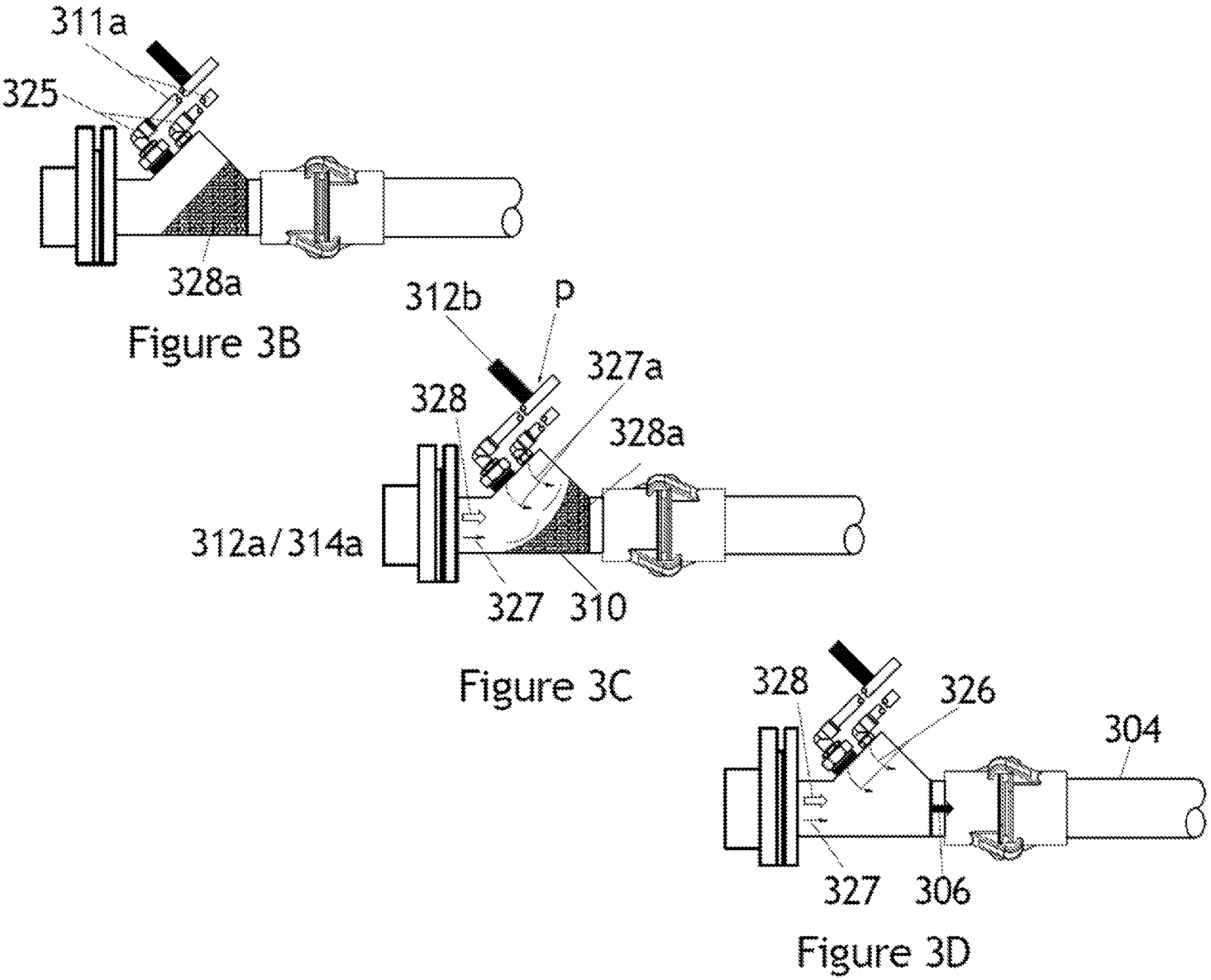
FIG. 3B shows a close-up side profile view of a mixer when the abrasive blasting system has a deadman assembly disengaged according to embodiments of the disclosure.
FIG. 3C shows a close-up side profile view of the mixer when the deadman assembly is engaged according to embodiments of the disclosure.
FIG. 3D shows a close-up side profile view of the mixer when the deadman assembly remains engaged according to embodiments of the disclosure.

FIG. 3A shows an isometric view of an abrasive blasting system 300 that may be part of an overall skid, meaning that one or more components may be coupled with or otherwise disposed on a skid or support frame structure 317. This means the system 300 may be readily portable and easily moved from job site to job site. One of skill would appreciate the basic nature of FIG. 3A does not show detail of valving, fittings, conduits, pumps, controls, etc. that might otherwise be present or necessary. FIGS. 3B-3D show the temporal events related to the engagement/disengagement of a deadman assembly 315.

Although not required, the system 300 may be configured to provide multi-mode functionality, which may include any of the following: no-flow; wet blast; dry blast; wash down; low pressure wash; air dry (air only); and so forth. The system 300 may be configured to be electrical, pneumatic, hydraulic, or as otherwise desired.

Whatever the operation needed, an operator 302 may interface with a control panel 318. The control panel 318 may have respective gauges or readouts 320 operable to provide various system indications, such as pressure or flow rate. The control panel 318 may also have dials, knobs, etc. 349 for the operator 302 to adjust or change flow rates, pressures, modes, etc.

Control of the system 300 may be via the control panel 318, but any other suitable mechanism may be used, such as wireless, remote, mobile device, or the like. Moreover, the control panel 318 may be digital, analog, or combinations thereof, or include a graphic user interface (GUI).

The system 300 may be operable to provide a single medium or mixture of any of air, water, and/or abrasive. In embodiments, the blast mixture may include wet abrasive and compressed air that may be discharged from a blast nozzle 305 coupled at an end of a blast hose 304. The blast hose 304 may have its other end configured with a hose mating feature or coupler 348*a* configured to engage a respective coupler 348*b* (e.g., flange) of the mixer 310. In the event greater reach is needed, the hose 304 may have a hose extension 304*a* coupled therewith.

The blast stream 306 out of the nozzle 305 may be used for removing rust, paint, or other unwanted surface defects. After blasting, the same system 300 may be used to wash off and/or dry the treated surface (208). Air flow 327 may be pressurized, such as via a compressor (not shown) and provided to the mixer 310 from an air source 312 via an auto air valve (or air control valve) 322 and air injection conduit 312*a*. Water flow 326 may also be pressurized, such as via a water pump (not shown here), and provided to the mixer 310 from a water source 311 via water injector (or spray nozzle) 325. The water source 311 may be a tank, which may be filled in batch or continuously from an off-skid feed. Water 326 may be selectively fed to the mixer 310, depending on the desired mode of operation.

Abrasive blast media 328 may be provided into the blast media source 314 (which may be a blast pot). The media source 314 may be configured with a removable top or other opening through which media 328 may be loaded thereinto. Loading may be, for example, bag loaded, or loaded from a larger storage hopper. In operation, the media source 314 may be pressurized (such as with compressed air from the compressor (not shown)). The pressure in the media source 314 may be raised until it is approximately equal to the air pressure in the mixer 310 where it connects with a media valve 324, which may facilitate gravity flow of the media 328.

From the media valve 324, the abrasive 328 may selectively flow or otherwise mix into the air flow 327, and this flow then into mixer 310. At the mixer 310, water 326 may be injected. In aspects, it may be the case that the water pressure be higher than the air pressure to assure that the air and abrasive mix 327/328 cannot back flow. The resultant mixture (or, could be single medium) may then flow through the hose 304, and then discharge out of the blast nozzle 305 and against a work surface (208).

Operation of any mode of the system 300 may occur when the deadman assembly 315 is engaged, with a particular mode being selected from the control panel 318. As one of skill would appreciate, when the deadman assembly 315 is engaged the system 300 may power up, and when the assembly is released the system 300 may shut down. The deadman assembly 315 (or respective wiring, networking, etc. 316) may be coupled (directly or indirectly) with the control panel 318 and other components of the system 300. In embodiments, wet-blasting may occur when a pump power source (not viewable here) is turned on and the deadman 315 engaged, which may open (such as electrically or pneumatically) a main water control valve.

When a main control device is activated (not viewable here) via the deadman 315, a control signal may correspondingly activate (e.g., open) the automatic air valve 322. Compressed air 327 may then flow to pressurize the blast hose 304 when the automatic air valve 322 is activated. At the same time, subject to the mode of operation, the metering valve 324 and/or the water control valve may activate or open, thereby allowing either or both of abrasive 328 to fall through and water 326 to be injected (see injectors 325) into the air stream 327 flowing to mixer 310. Note that a first or main water injector(s) 325 may be used in any mode that requires water flow.

As the injector 325 may be present, but not necessarily used, abrasive or other debris/particulate may inadvertently push into the injector 325 (such as its orifice). FIG. 3B in particular shows there may be remnant particulate or debris 328*a* in the mixer 310 (or elsewhere in system 300). This view may correspond to a static moment in time to when the deadman assembly 315 is disengaged.

To prevent or mitigate clogging, the air source 312 may be coupled to the injector(s) 325 via purge air conduit 312*b*. FIG. 3C shows that during engagement of the deadman 315 at $t_1$, there may be an immediate (or instantaneous) burst or pulse of airflow 327*a* directed into the water injection conduit(s) 311*a* at junction point P. The air conduit 312*a* may have an associated dimension (such as ID) larger than a respective dimension of the purge air conduit 312*b*. Thus, at $t_1$ the purge pulse 327*a* may have a larger pressure then airflow 327—it is the difference in pressure that facilitates the flow of air to form the pulse 327*a*.

Although at $t_1$ water 326 from water source 311 may flow into the water injection conduit 311*a*, as a result of configuration variables, the water 326 may not reach the junction point P until some amount of time after $t_1$, and thus after pulse 327*a* (i.e., water flow 326 may reach and pass the junction point P at a point of time $t_2$, as represented in FIG. 3D).

Prior to water reaching point P, the pulse of airflow 327*a* may thus successfully pass through the injector(s) 325 and into the mixer 310. The pulse 327*a* may be useful to help clear any remnant or flowing particulate (or other debris) 328*a* at $t_1$ from the mixer 310 (or any respective injection orifice—not shown here). The purge pulse 327*a* may prevent backflow, and essentially act as temporary injector dam until the air pressures in the purge/water lines and mixer 310 equalize. In a similar manner, once an activation signal is received from the deadman 315, and the relevant mode selected, the abrasive media 328 may transfer from the media storage 314 through a media transfer conduit 314*a* into the mixer 310 ($t_1$ or thereafter).

As shown in FIG. 3D, at $t_2$ (or any time thereafter for any further moment the deadman 315 remains engaged), water 326, air 327, and/or abrasive 328 may flow (or continue to flow) from their respective conduits 311*a*, 312*a*, 314*a* into the mixer 310. Upon mixing, the resultant blast or mix media 306 may discharge from the nozzle 305 and impact against the surface (208) to accomplish the desired blasting outcome. Once the deadman 315 is released, the sequence stops and may begin again upon subsequent (re)engagement. Operation of the system 300 stops when the deadman assembly 315 is disengaged, and the signal is removed from the control device.

Figure 4A:
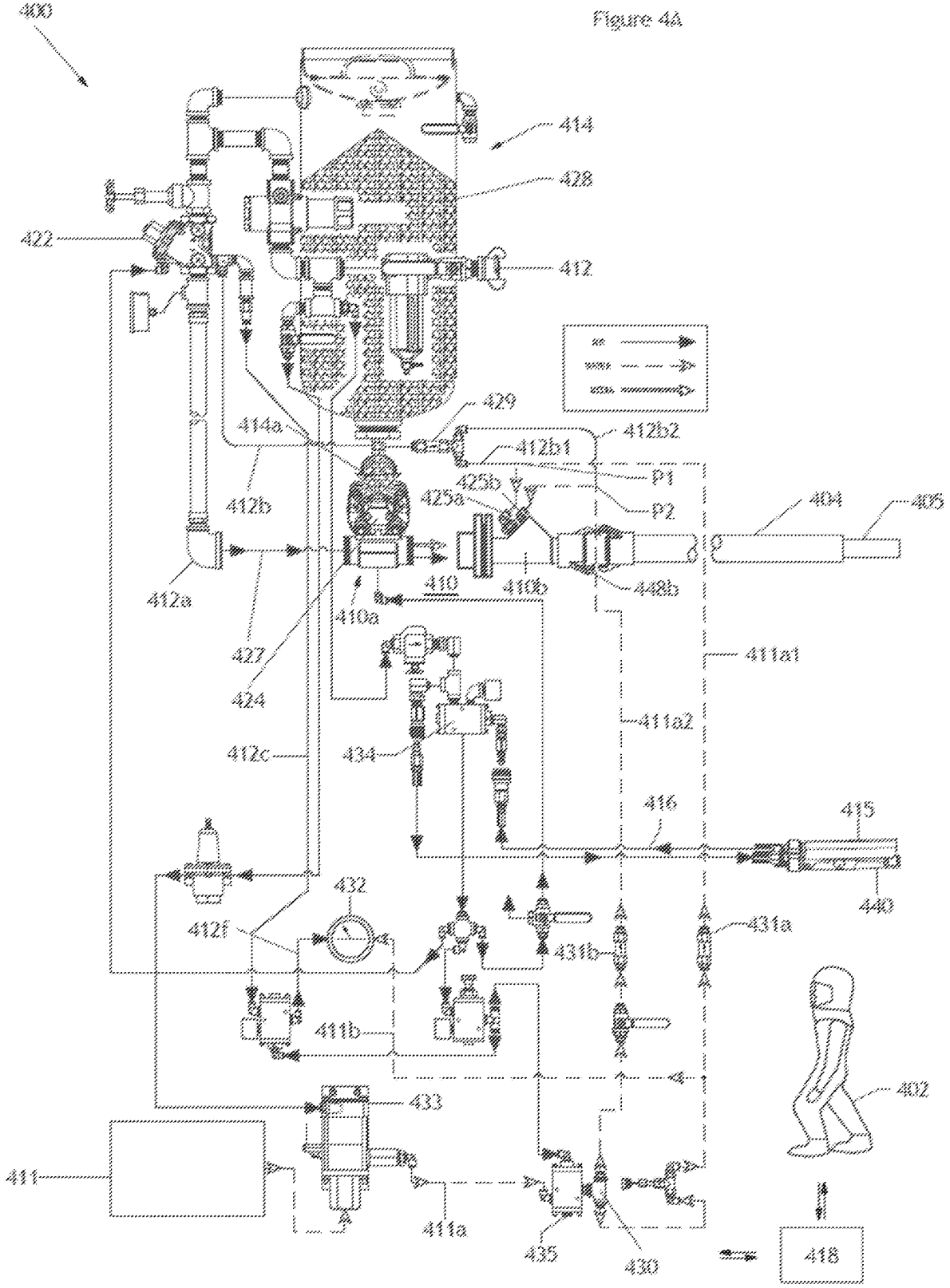
FIG. 4A shows a system component flow diagram of an abrasive blasting system having a water injection conduit configured with an air purge according to embodiments of the disclosure.
Figure 4B:
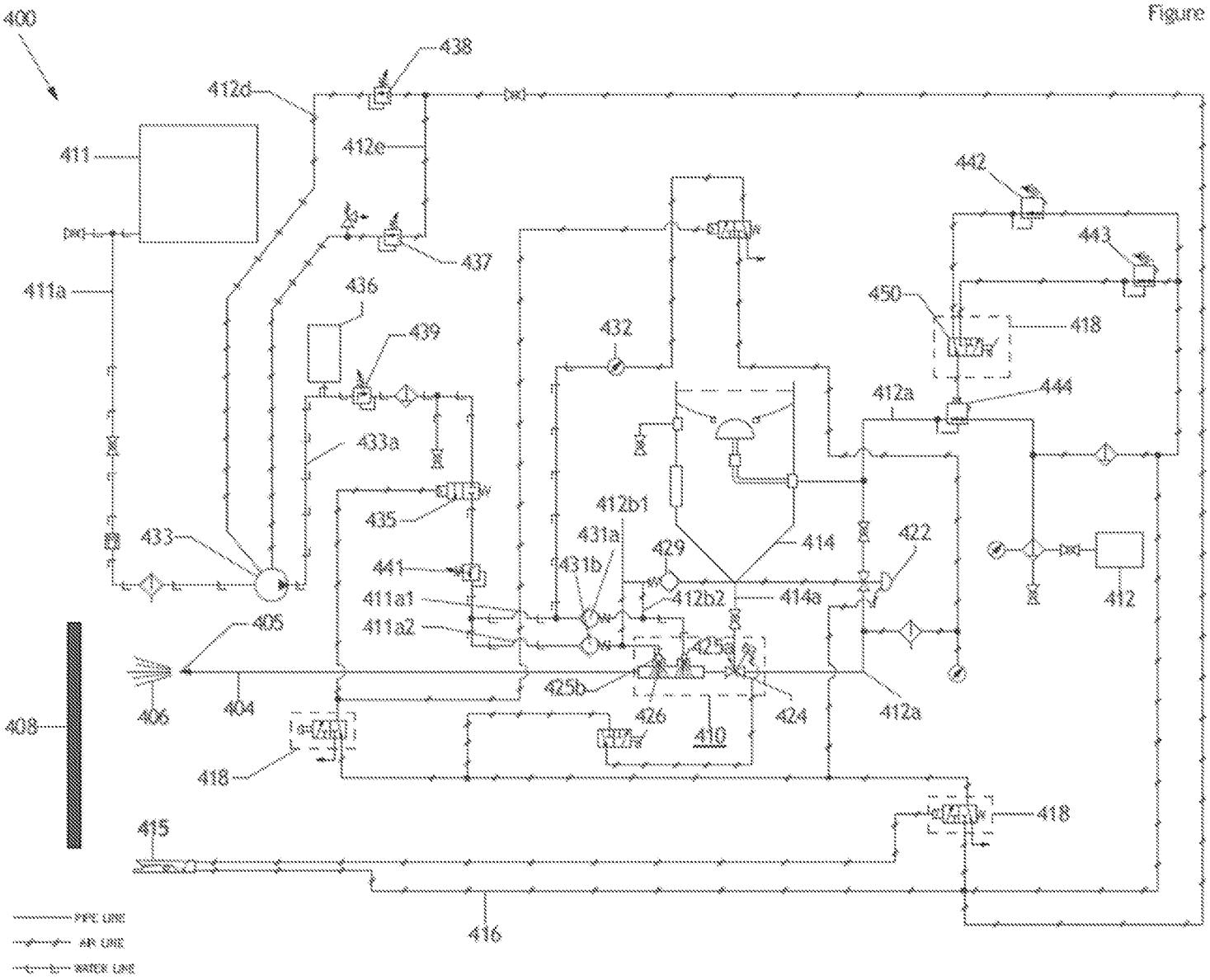
FIG. 4B shows a process schematic diagram of an abrasive blasting system having a two-regulator flow control scheme according to embodiments of the disclosure.

Referring now to FIGS. 4A and 4B, a system component flow diagram of an abrasive blasting system having a water injection conduit configured with an air purge and a process schematic diagram of an abrasive blasting system having a two-regulator flow control scheme, respectively, illustrative of embodiments disclosed herein, are shown.

FIGS. 4A and 4B together show a hybrid component-flow (and related schematic) diagram an abrasive blasting system 400 that may be comparable or identical in some aspects, function, operation, components, etc. as that of other system embodiments disclosed herein (e.g., 400, etc.), and analogous reference numbers may be used. Similarities may not be discussed for the sake of brevity, but may otherwise be evident to one of skill.

The system 400 may be configured to be electrical, pneumatic, hydraulic, or as otherwise desired. Whatever the operation needed, an operator 402 may interface with a control panel 418. The control panel 418 may have respective gauges or readouts (e.g., air/water differential gauge 432) operable to provide various system indications, such as pressure or flow rate. The control panel 418 may also have dials, knobs, etc. (e.g., mode selector 450) for the operator 402 to adjust or change flow rates, pressures, modes, etc.

The system 400 may be operable to provide a single medium or mixture of any of air 427, water 426, and/or abrasive 428. As such, depending on the mode selected, the blast stream 406 out of the nozzle 405 may be air, water, abrasive, or combinations thereof. While air and water or common, other gaseous or liquidous mediums are within the scope of the disclosure. Air may be used in wet blasting or dry blasting.

In embodiments, the blast stream 406 may include wet abrasive and compressed air that may be discharged from a blast nozzle 405 coupled at an end of a blast hose 404. The blast hose 404 may have its other end configured to engage a respective coupler 448*b* (e.g., flange) of a mixer or mixer section 410. The resultant blast stream 406 may be directed toward a target surface 408.

The mixer 410 may be passive in that a single material may pass therethrough (such as blowdown air). On the other hand, the mixer 410 may be contemplated as a focal point for the convergence of two or more of the air/water/abrasive mediums coming together for mixing. Just the same, the mixer 410 may also be contemplated as a mixing section having a first mixing portion 410*a* and a second mixing portion 410*b*. The first mixing portion 410*a* may be where air 427 and abrasive 428 mix together, which may then pass into the second mixing portion 410*b* to mix with water 426. The 'portions' 410 *a, b* may be conduits, piping, valves, etc.

The pressurized air 427 may flow into and through the first mixing portion 410*a* picking up any released abrasive 428, exiting as an air/abrasive mix. This mix may then flow into and through the second mixing portion 410*b*. Depending on the mode of operation of the system 400, pressurized water 426 may be injected into the air/media mix by the first water injector 425*a* (and/or second water injector 425*b*).

One of skill would appreciate that in a single mode of operation, mixing need not occur and the mixer 410 may be merely passive. Although not mean to be limited, the single mode of operation may be an air-only mode. As mentioned, water 426 from water source 411 may be injected or sprayed into the mixer 410 via one or more injectors or spray nozzles 425*a*, 425*b*. Water flow 426 from a water source 411 may be pressurized, such as via a water pump 433. Although not meant to be limited, the water pump 433 may be electrical or pneumatic.

In an electric configuration, the water pump 433 may have a set or constant flow rate. In a pneumatic configuration, the water pump 433 may be a reciprocating piston pump having a piston (not shown here) stroked via drive air. The water pump 433 may be two-ported, and thus receive pilot and drive air via 412*d*/412*e*. The flow rate characteristics of the pump 433 may be controlled via the air 412*d*/412*e*, such as via changing the setting of a drive air pressure regulator 437 and/or a pilot air pressure regulator 438. The regulators 437/438 may set or constant, or may be varied by changing a dial or other device on the control panel 418.

In aspects, the higher the setting of the pilot air pressure regulator 438, the higher the discharge pressure of water from the water pump 433. The operation of the pump 433 may depend on the deadman assembly 415, as the signal air depends on whether the assembly 415 is engaged or not, as well as the setting of the mode selector 450.

Air flow may also be pressurized, such as via a compressor (not shown) and provided to the mixer 410 from an air source 412 via an auto air valve 422 and an (first) air injection conduit 412*a*. Abrasive blast media 428 may be provided into the blast media source 414 (which may be a blast pot). In operation, the media source 414 may be pressurized (such as with compressed air), which may facilitate transfer of the media 428 through media conduit 414*a* and a media valve 424. The media valve 424 may accommodate mixing of the abrasive media 428 and the air 427 upstream of the water injection via injectors 425*a*, 425*b*. In aspects, the first mixing portion 410*a* may include the media valve 424.

Operation of any mode of the system 400 may commence when the deadman assembly 41S is engaged, with a particular mode being selected from the mode selector 450. The deadman assembly 415 (or respective wiring, tubing, twin-line, networking, etc. 416) may be coupled (directly or indirectly) with the control panel 418, and thus also have an operable relationship with the mode selector 450.

The position of the mode selector 450 may determine which supplemental air regulator provides what amount of air pressure to the blast hose 404. For example, the wet blast mode may use blast air pressure regulator 442, and wash-down mode may use wash down air regulator 443, as these modes might have different air pressure needs. The blast pressure regulator 442 and/or the wash down regulator 443 may determine the setting of air slave regulator 444.

In embodiments, wet blasting may occur when a pump power source (not viewable here) is turned on and the deadman 415 engaged, which may open (such as electrically or pneumatically) a main water control valve 435.

When a main or deadman control device 434 is activated via the deadman 415, a control signal may correspondingly activate (e.g., open) the automatic air valve 422. Compressed air 427 may then flow to pressurize the blast hose 404 when the automatic air valve 422 is activated. At the same time, the metering valve 424 and the water control valve 435 may activate or open, thereby allowing the abrasive 428 to fall through and/or water 426 to be injected into the air stream 427 flowing to mixer 410. Note that injector(s) 425*a*, 425*b* may be used in the respective blast/wash mode that requires water flow.

To prevent or mitigate clogging of the injector(s) 425*a*. 425*b*, the air source 412 may be coupled to the injector 425*a*, 425*b* via respective purge lines 412*b*1 and 412*b*2. During initial engagement of the deadman 415, there may be an immediate (or instantaneous) burst or pulse of airflow directed into the water injection conduit(s) 411*a*1 and 411*a*2 at respective junction points P1, P2. After a moment needed for the pulse, water 426 may reach and pass the junction points P1, P2, and pass into the mixer 410.

The purge lines 412*b*1 and 412*b*2 may coupled with a check valve 429, which itself may be coupled with the air valve 422. The check valve 429 may provide or precede a split of the purge line 412*b*. The check valve 429 may prevent backflow from the injectors 425*a*, 425*b* back into the purge line 412*b*, which is of importance for any mode where water is used.

In embodiments, when the air valve 422 opens or activates, air 427 may be sent not only through the blast nozzle 405, but also to the injectors 425*a*, 425*b* through the lines 412*b*/412*b*1/412*b*2. In the event of a mode that doesn't use water, air 427 may backflow into water feed lines 411*a*1 and/or 411*a*2; however, the air will not backflow any further than the respective water check valves 431*a*. 431*b*.

Operation of the system 400 may stop when the deadman assembly 415 is disengaged, and the signal is removed from the control device 434.

Water Regulating and Control

Depending on the mode selector 450, water may not be needed at all times during operation of the system 400. One mode of operation may include air-only or blow off. In this mode, the system 400 may provide a blast of compressed air out of the nozzle 405 to blow dry and ready the surface 408 for finishing, such as painting. This feature basically allows two settings of air pressure. One for blasting, which may generally be greater than 80 psig. The washdown and blow off could be the same as blast air pressure or lower pressures such as 40 psig. The operator 402 may use the control panel 418 to adjust the desired air pressure using an air pressure regulator (not viewable here).

In any mode (such as wet blast or wash mode) where water may be used, the pressure and flow rate of the flow of water 426 may be regulated. Some control methodologies may provide various advantages over others, and may depend on whether the system 400 has an electrical or pneumatic operational scheme. It may be useful or desirous to have more precision in water usage of the system 400. In this respect, there may be a first or main water regulator 439, which may be coupled with a discharge side 433*a* of the water pump 433. As the injector(s) 425*a*, 425*b* may be a fixed orifice, the more water pumped (i.e., the higher the flow rate), the greater the pressure.

The main water regulator 439 may also be coupled with the water control valve 435. The secondary water pressure regulator 441 may regulate the water to the water side of the differential pressure gauge 432, even if only intermediately as may be predetermined via the mode selector position. The differential pressure gauge 432 may be positioned between water pressure line 411*b* and blast air pressure line 412*f*, and thus may be used to help indicate, quantify, and control water flow.

The differential pressure gauge 432 may be configured to measure and indicate the difference between the water pressure and blast air pressure, since water injection into the mixer 410 cannot be achieved unless the water pressure is greater than the blast air pressure.

The differential pressure gauge 432 may provide the operator 402 with a visual indication of water (volume) flow rate. The pressure differential gauge 432 and the water control valve 435 may be operable together to provide the operator 402 with the means to consistently, precisely, and repeatedly control the water flow rate. The control of the water flow is important because the operator 402 may adjust the water flow according to the abrasive type, abrasive size, abrasive flow rate, dust content, blast nozzle size, blast pressure, and other blast equipment operating parameters.

As mentioned, system 400 may have multiple modes of operation. For example, in the event of wet blasting, the surface 408 may be left with residual abrasive and fine dust, for which the operator 402 may wish to rinse to wash the abrasive off the surface. The water flow rate for washdown may be significantly higher than the water flow rate during blasting, which is usually for dust control. As such, water from the control valve 435 may be split, such as via splitter 430, whereby water may be fed to the first injector 425*a* and/or to the second injector 425*b*. For example, both the injectors 425*a*, 425*b* may be used in washdown mode. The cracking pressure for the wet-blast check valve 431*a* is very low so it will be on when the air pressure is reduced and the cracking pressure is reached on the washdown check valve 431*b*.

It may thus be desirable to use the second water injector 425*b* as corresponding to a washdown mode. The second water injector 425*b* may be configured to provide increased water pressure and flow rate, as when more pressure and water volume is required than can be delivered by the first water injector 425*a*.

The main water regulator 439 may also be used to lower and stabilize the pressure from the pump 433. For example, the pump 433 may have a discharge pressure of about 250 psig to about 300 psig, whereas the main water regulator 439 may reduce the pressure to a lower or regulated pressure. The (first) regulated pressure may be in the range of about 150 psig to about 200 psig. The regulated pressure may be about 175 psig. Water regulated at this pressure may be useful for washdown.

The main water regulator 439 may help or facilitate smoothing out the discharge flow and pressure of the water pump 433. It has been discovered that the differential pressure gauge 432 may show jumps or fluctuations in the water flow that may result from a reciprocating piston-type water pump.

There may be a snubber 436 disposed between the pump discharge 433*a* and the main water regulator 439. The snubber 436 may further help or facilitate smoothing out the discharge flow and pressure from the water pump 433. The snubber 436 may have an air pad that corresponds to providing a shock absorber effect on the flow of water. Meaning, as water from the discharge of the pump 433 may have a fluctuation in pressure, the volume of the snubber 436 may correspondingly fluctuate (e.g., by compressing air therein). The pressure and flow of the water to the main water regulator 439 may then be more consistent and even, as water pulsing may be eliminated or mitigated. The main water regulator 439 may be considered a course adjustment to the water pressure and flow. The main water regulator 439 may have a main water regulator setting adjustable via the control panel 418.

In comparison to a single point adjustment (such as a regulator/needle valve), the system 400 may thus have a two-point adjustment (e.g., pressure and cross-sectional flow area), where the water pressure in may be simply and precisely fine-tuned by a second water regulator 441. The second water regulator 441 may be in series with the main water regulator 439. The second water regulator 441 may help set or determine the differential pressure read by the differential pressure gauge 432. The second water regulator 441 may further contribute to the smoothing and evening out of the water flow 426 to the injector(s) 425. The second water regulator 441 may provide a fine adjustment to obtain the desired water pressure and flow. The second water regulator 441 may have a second water regulator setting adjustable via the control panel 418.

Another benefit of using multi-regulator arrangement is in the event the system 400 is configured as a multi-port or -outlet system (not viewable here) for multiple blast hoses 404 to be coupled therewith. That way each individual operator 402 may control his/her respective water requirement via adjustment of respective second water regulator 441 that branches off from the main water regulator 439.

While preferred embodiments of the disclosure have been shown and described, modifications thereof may be made by one skilled in the art without departing from the spirit and teachings of the disclosure. The embodiments described herein are exemplary only and are not intended to be limiting. Many variations and modifications of the embodiments disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. An abrasive blasting system comprising:

a blast hose;

a mixer coupled with the blast hose;

a deadman assembly operably configured in a deadman position of one of: a signal-flow position and a signal-no flow position;

an air source coupled with the mixer via an air injection conduit in order to provide an air flow to the mixer in response to the deadman position;

a water source coupled with the mixer via a water injection conduit;

an air flow valve;

a water control valve;

a purge line coupled between the air flow valve and the water injection conduit; and an abrasive source coupled with the mixer via a media conduit in order to provide a media flow in the mixer in response to the deadman position, wherein upon engagement of the deadman assembly to the signal-flow position, at least part of the air flow is diverted into the mixer via the water injection conduit.

2. The abrasive blasting system of claim 1, the system further comprising:

a control panel configured with a mode selector operably coupled with the water source;

and a second water injector disposed in the mixer, wherein a water flow from the water source is provided to the mixer based upon a mode selector position of the mode selector.

3. The abrasive blasting system of claim 2, wherein the mode selector position comprises: a water blast mode and a water washdown mode, and wherein the pressure of the air flow in the mixer in the water blast mode is greater than the pressure of the water flow in the mixer in the water washdown mode.

4. The abrasive blasting system of claim 1, the system further comprising:

a water pump for providing a pressurized water from the water source to the water injection conduit; and a first water regulator for controlling an operation parameter of the pressurized water.

5. The abrasive blasting system of claim 1, the system further comprising:

a first water regulator; and a second water regulator in fluid communication with the first water regulator, the first water regulator operable to stabilize a water flow rate and a water pressure of a water flow to the second water regulator.

6. An abrasive blasting system comprising:

a blast hose;

a mixer coupled with the blast hose;

a water pump operable to provide a pressurized water flow;

a main water regulator configured to directly or indirectly receive the pressurized water flow and reduce its pressure to form a first reduced pressure flow;

a second water regulator configured to receive the first reduced pressure flow and reduce its pressure to form a second reduced pressure flow;

a deadman assembly operably configured to be in a deadman position of one of: a signal-flow position and a signal-no flow position;

an air source coupled with the mixer via an air injection conduit in order to provide an air flow to the mixer in response to the deadman position;

a water source coupled with the water pump in order to provide a water flow to the water pump in response to the deadman position;

an abrasive source coupled with the mixer via a media conduit in order to provide a media flow in the mixer in response to the deadman position;

a first water injector coupled with each of the air source and the water source;

an air flow valve;

a water control valve; and a second water injector configured to receive pressurized air from the air flow valve via a respective purge line coupled between the air flow valve and the second water injector, wherein a purge line is coupled between the air flow valve and the first water injector, wherein upon engagement of the deadman assembly to the signal-flow position, at least part of the air flow is diverted into the mixer via the first water injector.

7. An abrasive blasting system comprising:

a blast hose;

a mixer coupled with the blast hose;

a water pump operable to provide a pressurized water flow;

a main water regulator;

a second water regulator downstream and in fluid communication with the main water regulator;

a deadman assembly operably configured to be in a deadman position of one of: a signal-flow position and a signal-no flow position;

an air source coupled with the mixer via an air injection conduit in order to provide an air flow to the mixer in response to the deadman position;

a water source coupled with the water pump in order to provide a water flow to the water pump in response to the deadman position;

an abrasive source coupled with the mixer via a media conduit in order to provide a media flow in the mixer in response to the deadman position;

a first water injector in fluid communication with each of the air source and the water source;

an air flow valve; and a water control valve, wherein a purge line is coupled between the air flow valve and the first water injector, and wherein upon engagement of the deadman assembly to the signal-flow position, at least part of the air flow is diverted into the mixer via the first water injector.

8. The abrasive blasting system of claim 7, the system further comprising:

a snubber.

9. The abrasive blasting system of claim 7, the system further comprising:

a second water injector configured to receive pressurized air from the air flow valve via a respective purge line coupled between the air flow valve and the second water injector.

10. The abrasive blasting system of claim 9, the system further comprising:

a control panel configured with a mode selector operably coupled with the water source;

wherein the water flow is provided to the mixer via at least one of the first water injector, the second water injector, and combinations thereof, based upon a mode selector position of the mode selector.

11. The abrasive blasting system of claim 10, wherein the mode selector position comprises: a water blast mode and a water washdown mode, and wherein the pressure of the air flow in the mixer in the water blast mode is greater than the pressure of the water flow in the mixer in the water washdown mode.

12. The abrasive blasting system of claim 11, the system further comprising:

a blast mode check valve disposed between the second water regulator and the first water injector; and a washdown check valve disposed between the second water regulator and the second water injector, wherein a cracking pressure of the blast mode check valve is less than a respective cracking pressure of the washdown check valve.

13. The abrasive blasting system of claim 10, wherein backflow of any abrasive or water through the first water injector is prevented by pressurized air transferred from the air flow valve in dry blast and blowdown modes.

14. The abrasive blasting system of claim 13, wherein backflow of any abrasive or water through the first water injector is prevented by pressurized water transferred from the second regulator in either of a water blast mode and a water washdown mode.

15. The abrasive blasting system of claim 13, wherein backflow of any abrasive or water through the second water injector is prevented by pressurized air transferred from the air flow valve in dry blast, water blast or blowdown modes.

16. The abrasive blasting system of claim 13, wherein backflow of any abrasive or water through the second water injector is prevented by pressurized water transferred from the second regulator in a water washdown mode.

17. The abrasive blasting system of claim 13, wherein backflow of any water through the purge line to the air flow valve is prevented by the blast mode and washdown check valves.

* * * * *